US009522454B2

(12) United States Patent
Moudry et al.

(10) Patent No.: US 9,522,454 B2
(45) Date of Patent: Dec. 20, 2016

(54) METHOD OF PATTERNING A LAPPING PLATE, AND PATTERNED LAPPING PLATES

(71) Applicant: Seagate Technology LLC, Cupertino, CA (US)

(72) Inventors: Raymond Leroy Moudry, Bloomington, MN (US); Joel William Hoehn, Hudson, WI (US)

(73) Assignee: SEAGATE TECHNOLOGY LLC, Cupertino, CA (US)

( * ) Notice: Subject to any disclaimer, the term of this patent is extended or adjusted under 35 U.S.C. 154(b) by 476 days.

(21) Appl. No.: 13/716,456

(22) Filed: Dec. 17, 2012

(65) Prior Publication Data

US 2014/0170944 A1 Jun. 19, 2014

(51) Int. Cl.
*B24B 37/16* (2012.01)
*B24B 37/26* (2012.01)
*B24D 18/00* (2006.01)

(52) U.S. Cl.
CPC ..... *B24B 37/16* (2013.01); *B24B 37/26* (2013.01); *B24D 18/0009* (2013.01)

(58) Field of Classification Search
CPC ..... B24B 37/12; B24B 37/16; B24B 37/26; B24B 7/00; B24B 7/02; B24D 7/00; B24D 7/02; B24D 18/0009
USPC ..... 451/540, 548, 550, 905, 527
See application file for complete search history.

(56) References Cited

U.S. PATENT DOCUMENTS 3,921,342 A 11/1975 Day
4,037,367 A 7/1977 Kruse
4,369,604 A * 1/1983 Kaganowicz ..... G11B 3/56 369/126
4,821,461 A 4/1989 Holmstrand
4,866,886 A 9/1989 Holmstrand
5,899,799 A * 5/1999 Tjaden ..... B24B 57/02 15/102
5,946,991 A 9/1999 Hoopman
5,975,987 A 11/1999 Hoopman et al.
6,050,879 A 4/2000 Dubrovskiy et al.
6,093,651 A * 7/2000 Andideh ..... B24B 37/26 216/38
6,443,810 B1 * 9/2002 Shih ..... B24B 37/16 451/285

(Continued)

FOREIGN PATENT DOCUMENTS

JP H04-102769 A 4/1992
JP 2002-292573 10/2002

(Continued)

OTHER PUBLICATIONS

English translation of Korean Office Action issued Apr. 7, 2015, in application KR10-2013-0157335, 5 pages.

(Continued)

*Primary Examiner* — Eileen Morgan
(74) *Attorney, Agent, or Firm* — Holzer Patel Drennan

(57) ABSTRACT

A method of forming a patterned lapping plate by providing a working tool having a pattern comprising a plurality of raised teeth, each of the raised teeth having a base, at least one side wall, and a terminal end, and patterning the lapping plate with the tool to provide a working surface having an inverse pattern of the tool surface in the working surface of the lapping plate, the patterning process plastically deforming the working surface of the lapping plate.

16 Claims, 7 Drawing Sheets

(56) References Cited

U.S. PATENT DOCUMENTS

| | | | | |
|---|---|---|---|---|
| 6,539,277 | B1 | 3/2003 | Alvis | |
| 6,540,590 | B1 * | 4/2003 | Kajiwara | B24B 37/16 451/285 |
| 6,802,761 | B1 | 10/2004 | Beaucage et al. | |
| 7,234,224 | B1 * | 6/2007 | Naugler | B23C 3/34 29/557 |
| 7,410,410 | B2 | 8/2008 | Mahadev et al. | |
| 7,662,021 | B2 | 2/2010 | Gee et al. | |
| 8,062,098 | B2 | 11/2011 | Duescher | |
| 2001/0031612 | A1 | 10/2001 | Scott et al. | |
| 2002/0068516 | A1 * | 6/2002 | Chen | B24B 37/16 451/285 |
| 2003/0060144 | A1 | 3/2003 | Taylor | |
| 2003/0119425 | A1 * | 6/2003 | Suzuki | B23B 27/04 451/41 |
| 2003/0132207 | A1 * | 7/2003 | Park | B23K 26/0823 219/121.69 |
| 2003/0150169 | A1 | 8/2003 | Annen | |
| 2005/0276967 | A1 * | 12/2005 | Prasad | B24B 37/24 428/314.8 |
| 2006/0154577 | A1 * | 7/2006 | Suzuki | B24B 37/26 451/56 |
| 2006/0229002 | A1 * | 10/2006 | Muldowney | B24B 37/26 451/56 |
| 2007/0015442 | A1 * | 1/2007 | Shin | B24B 37/042 451/8 |
| 2007/0032182 | A1 * | 2/2007 | Suzuki | B24D 3/28 451/527 |
| 2007/0066195 | A1 * | 3/2007 | Duong | B24B 37/24 451/526 |
| 2007/0082587 | A1 * | 4/2007 | Hosaka | B24B 19/028 451/56 |
| 2007/0149096 | A1 * | 6/2007 | Nishimura | B24B 37/26 451/41 |
| 2007/0232200 | A1 * | 10/2007 | Natsui | B24B 7/228 451/41 |
| 2008/0139089 | A1 * | 6/2008 | Aoki | B24B 37/044 451/37 |
| 2009/0258575 | A1 * | 10/2009 | Hreha | B24B 37/24 451/37 |
| 2011/0195646 | A1 * | 8/2011 | Kim | B24B 37/22 451/532 |
| 2011/0239444 | A1 * | 10/2011 | Fukuoka | B24B 37/11 29/603.16 |
| 2012/0009856 | A1 | 1/2012 | Moudry et al. | |

FOREIGN PATENT DOCUMENTS

| | | | |
|---|---|---|---|
| JP | 2005-118988 | A | 5/2005 |
| JP | 2010-194692 | A | 9/2010 |
| JP | 2013-240844 | A | 12/2013 |
| KR | 1999-0063984 | | 7/1999 |
| KR | 2004-0068359 | | 7/2004 |

OTHER PUBLICATIONS

Office Action dated Aug. 31, 2015 from corresponding Chinese patent application No. 201310757298.6.

Communication Pursuant to Art. 94(3) EPO dated Sep. 7, 2015 from corresponding European patent application No. 13 197 788.6.

* cited by examiner

METHOD OF PATTERNING A LAPPING PLATE, AND PATTERNED LAPPING PLATES

BACKGROUND

Hard disc drive systems (HDDs) typically include one or more data storage discs. A transducing head carried by a slider is used to read from and write to a data track on a disc. The slider is carried by an arm assembly that includes an actuator arm and a suspension assembly, which can include a separate gimbal structure or can integrally form a gimbal.

The density of data stored on a disc continues to increase, requiring more precise positioning of the transducing head. Conventionally, in many systems, head positioning is accomplished by operating the actuator arm with a large scale actuation motor, such as a voice coil motor, to position a head on a flexure at the end of the actuator arm. A high resolution head positioning mechanism, or microactuator, is advantageous to accommodate the high data density. The microactuator is often a piezoelectric microactuator.

Electrical connections between various elements in the HDD system should be strong, resist breakage, and have good electrical conductivity. Improved electrical connections are always desirable. The present disclosure provides sliders and transducing heads with improved electrical connections.

SUMMARY

One particular embodiment of this disclosure is a method of patterning a lapping plate. The method includes providing a working tool having a pattern comprising a plurality of raised teeth, each of the raised teeth having a base, at least one side wall, and a terminal end, and patterning the lapping plate with the tool to provide a working surface having an inverse pattern of the tool surface in the working surface of the lapping plate, the patterning process plastically deforming the working surface of the lapping plate.

Another particular embodiment of this disclosure is a patterned lapping plate. The lapping plate comprises a working surface comprising a plurality of discrete indents separated by a continuous land area. Each indent has a depth from the working surface to a terminal end of the indents of no more than 100 micrometers, slanted side walls extending from the working surface to a terminal end of the indent, and a largest dimension of the indent at the working surface of no greater than 1000 micrometers.

Another particular embodiment of this disclosure is a patterned lapping plate. The lapping plate comprises a working surface comprising a groove spiraling about a central axis of the lapping plate forming a plurality of turns, and land area positioned between adjacent turns of the spiraling groove. The groove has slanted side walls extending from the working surface to a terminal end of the groove, a depth from the working surface to the terminal end of no more than 100 micrometers, and a varying width along the length of the groove.

These and various other features and advantages will be apparent from a reading of the following detailed description.

BRIEF DESCRIPTION OF THE DRAWING

The disclosure may be more completely understood in consideration of the following detailed description of various embodiments of the disclosure in connection with the accompanying drawing, in which.

DETAILED DESCRIPTION

Figure 1:
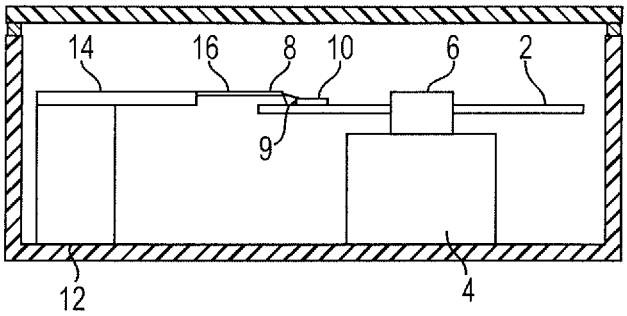
FIG. 1 is a sectional side view of a magnetic recording disc drive and slider assembly.

The present embodiments relate most generally to the manufacture of abrading tools. For purposes of this description, although not so limited, reference is made to the use of an abrading tool in high precision lapping of sliders and the supported magnetic transducing heads used in data storage devices. The sliders and particularly the heads, operably used to store and retrieve data on rotatable magnetic recording discs, require extremely precise manufacturing tolerances. The present disclosure provides a method of abrading (lapping) the slider with a lapping plate or platen having a patterned working surface.

Lapping processes utilize either oscillatory or rotary motion of a slider bar across a rotating lapping plate to provide a random motion of the slider bar over the lapping plate and randomize plate imperfections across the head surface in the course of lapping. Some lapping plates have an abrasiveless horizontal working surface and are used in conjunction with a slurry of abrasive particles (e.g., diamonds), whereas other lapping plates have abrasive particles (e.g., diamonds) embedded in the horizontal working surface. The general idea of interrupting the lapping surface, for example by forming grooves in the lapping plate, is known in the art. The patterned surface reduces hydroplaning of the slider bar on the working surface and liquid and debris (swarf) are centrifugally removed beyond the lapping plate periphery.

Problems exist with grooved plates, for example, excessive width and/or depth of grooves allow abrasive particles to loose their effectiveness due to lack of contact with the slider bar. Grooves that are too wide provide surface discontinuity too severe for small work pieces. Even if the grooves can be sized properly, forming the grooves can be costly and time consuming. Additionally, over time the lapping plate wears and dulls, requiring refurbishment of the working surface, which again can be time consuming and expensive, and which greatly shortens the total useful life of the lapping plate. By forming a pattern in the lapping plate, as per the present disclosure, improvements over conventional grooved plates are observed. Because the patterning process plastically deforms the lapping plate surface rather than removing material, the useful life of the lapping plate is extended by providing for repeated refurbishment of the patterned surface. Additionally, a slider bar lapped on a lapping plate patterned by the methods of this disclosure has decreased microwaviness compared to one lapped on a lapping plate patterned by other methods.

In the following description, reference is made to the accompanying drawing that forms a part hereof and in which are shown by way of illustration at least one specific embodiment. The following description provides additional specific embodiments. It is to be understood that other embodiments are contemplated and may be made without departing from the scope or spirit of the present disclosure. The following detailed description, therefore, is not to be taken in a limiting sense. While the present disclosure is not so limited, an appreciation of various aspects of the disclosure will be gained through a discussion of the examples provided below.

Unless otherwise indicated, all numbers expressing feature sizes, amounts, and physical properties are to be understood as being modified by the term "about." Accordingly, unless indicated to the contrary, the numerical parameters set forth are approximations that can vary depending upon the desired properties sought to be obtained by those skilled in the art utilizing the teachings disclosed herein.

As used herein, the singular forms "a", "an", and "the" encompass embodiments having plural referents, unless the content clearly dictates otherwise. As used in this specification and the appended claims, the term "or" is generally employed in its sense including "and/or" unless the content clearly dictates otherwise.

Figure 2:
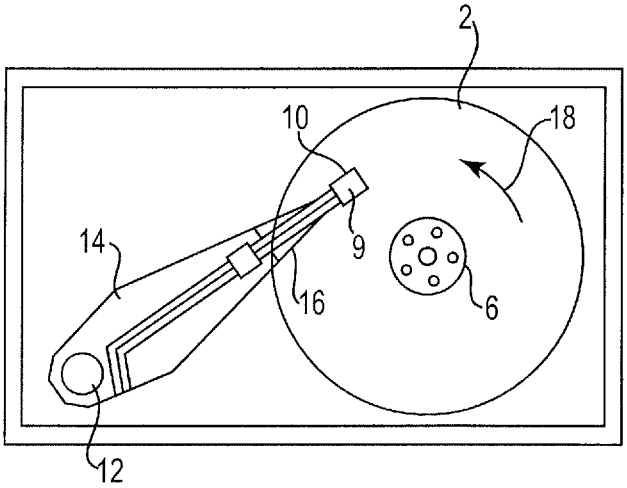
FIG. 2 is a top view of the magnetic recording disc drive and slider assembly of FIG. 1.

Referring to FIGS. 1 and 2, a generic magnetic recording disc drive is illustrated, having a magnetic recording disc 2 which is rotated by drive motor 4 with hub 6 which is attached to the drive motor 4. A read/write head or transducer 8 is present on the trailing end or surface 9 of a slider 10. Slider 10 is connected an actuator 12 by means of a rigid arm 14 and a suspension element 16. Suspension element 16 provides a bias force which urges slider 10 toward the surface of disc 2. During operation of the disc drive, drive motor 4 rotates disc 2 at a constant speed in the direction of arrow 18 and actuator 12 which is typically a linear or rotary motion coil motor drives slider 10 generally radially across the plane of the surface of disc 2 so that read/write head 8 may access different data tracks on disc 2.

In order to meet the increasing demands for more and more data storage capacity on disc 2, slider fabrication and finishing must be improved to meet these demands. To meet these demands, lapping and polishing methodology must be developed which enhance slider features. Typically, numerous sliders are fabricated from a single wafer having rows of magnetic transducer heads deposited simultaneously on the wafer surface using semiconductor-type process methods. Single-row bars are sliced from the wafer, each bar being a row of units that are further processed into sliders each having one or more magnetic transducers or heads on their end faces. Each bar is bonded to a fixture or tool for further processing and then further diced i.e., separated into individual sliders.

In order to achieve maximum efficiency of the slider during use, the head, particularly the sensing elements of the head, must have precise dimensions. During manufacturing, it is most critical to grind or lap these elements to very close tolerances of desired thickness in order to achieve the unimpaired functionality required of sliders. The present disclosure provides a lapping plate that provides the needed close tolerances while maintaining long plate life. The lapping plate is formed using a toothed patterning tool, which plastically deforms the surface of a lapping plate to form a pattern on the working surface.

Figure 3A:
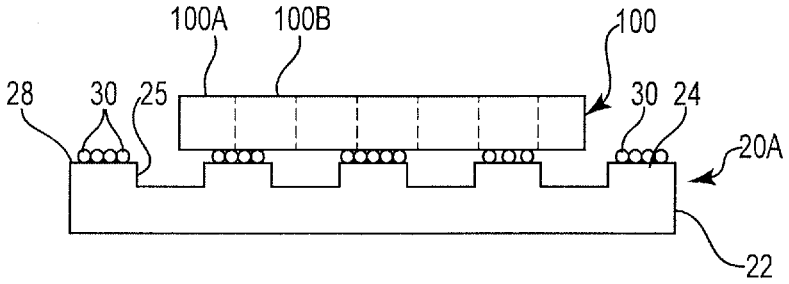
FIG. 3A is a schematic side view of an embodiment of a lapping plate and a slider bar.
Figure 3B:
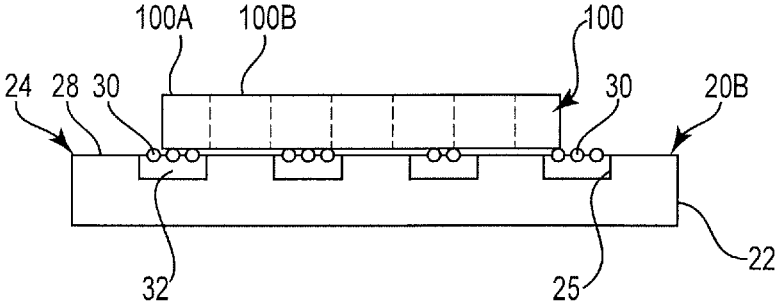
FIG. 3B is a schematic side view of an alternate embodiment of a lapping plate and a slider bar.

FIGS. 3A and 3B diagrammatically depict a lapping plate (also often referred to as a platen) used for machining a slider bar, the plate having been made in accordance with the present disclosure. FIG. 3A illustrates a first embodiment as lapping plate 20A and FIG. 3B illustrates a second embodiment as lapping plate 20B. Lapping plates 20A and 20B have the same overall general features, and discussion relating to one embodiment also applies to the other embodiment, unless specifically indicated otherwise. Lapping plate 20A, 20B has a body 22 with a working or lapping surface 24 in or on which abrasive particles 30 are present. Body 22 has a plurality of indents or cavities 25 therein, with a plurality of land areas 28 between indents 25. Indents 25 were formed by a toothed patterning tool, the tool and method being described below. Lapping plate 20A of FIG. 3A has abrasive particles 30 present on land areas 28, whereas lapping place 20B of FIG. 3B has abrasive particles 30 present in indents 25.

Referring to FIG. 3A, abrasive particles 30 may be present on land areas 28. Abrasive particles 30 may be electroplated onto land areas 28, adhesively applied, or may be physically pressed into land areas 28 and mechanically held. One method for physically pressing abrasive particles 30 into land areas 28 is by applying an abrasive slurry to a working surface 24 that is composed of a soft metal (e.g., a tin alloy). With the application of pressure, abrasive particles 30 are embedded into the soft metal. Alternately, abrasive particles 30 may be present in indents 25, as illustrated in FIG. 3B. In FIG. 3B, abrasive particles 30 are held in indents 25 via an adhesive (e.g., epoxy) 32. Additional details regarding using an adhesive in the indents to hold abrasive particles can be found in U.S. Patent Publication No. 2012/0009856, the entire disclosure of which is incorporated herein by reference.

In use, lapping plate 20A, 20B is rotated relative to a slider bar 100 containing a plurality of sliders 100A, 100B, etc. held in a pressing engagement against working surface 24. The abrading action due to abrasive particles 30 at working surface 24 removes material from slider bar 100. Having the regions free of abrasive particles (i.e., indents 25 in FIG. 3A, and land areas 28 in FIG. 3B) reduces hydroplaning of slider bar 100 on lapping plate 20A, 20B and decreases microwaviness on slider bar 100.

Figure 4:
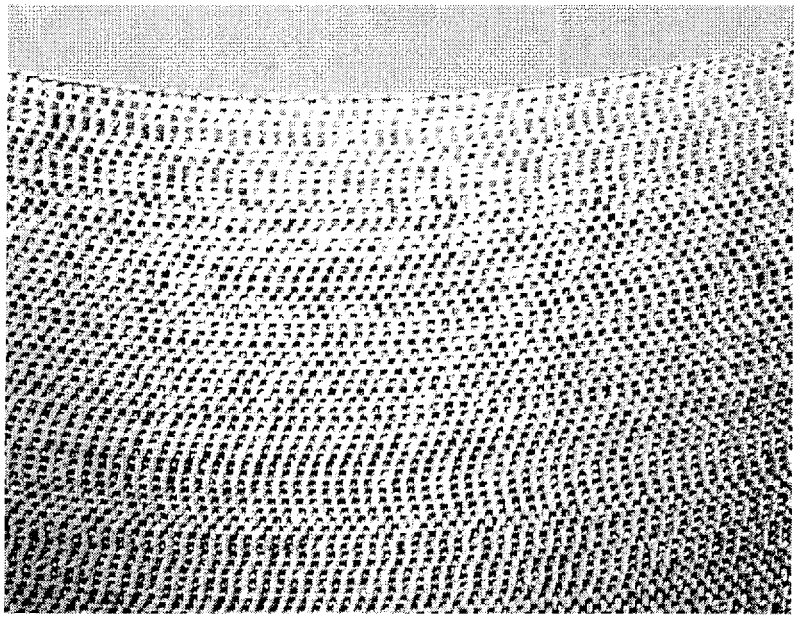
FIG. 4 is a top plan view of a patterned lapping plate constructed in accordance with embodiments of the present disclosure.
Figure 5:
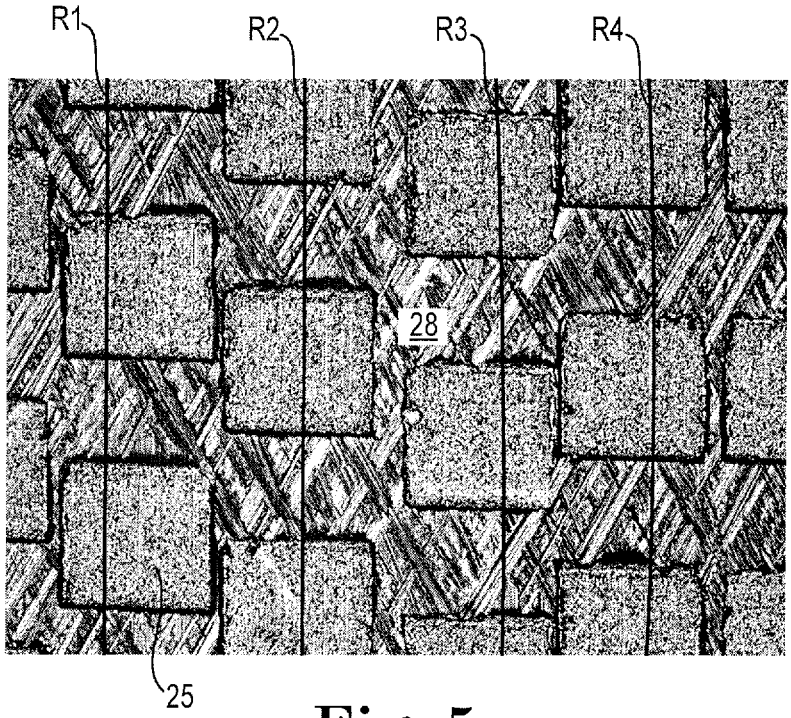
FIG. 5 is an enlarged top plan view of a patterned lapping plate constructed in accordance with embodiments of the present disclosure.

FIGS. 4 and 5 show the working surface of a lapping plate having a plurality of discrete, individual indents or cavities in the working surface. FIG. 4 shows a partial section of a circular lapping plate having an annular working surface and FIG. 5 is an enlarged view of a portion of FIG. 4. The working surface shown has a plurality of indents 25 arranged in essentially parallel rows, identified as rows R1, R2, R3 and R4 in FIG. 5. Present between indents 25 are land areas 28. When indents 25 are individual and discrete indents, as in these figures, land area 28 is a continuous surface interrupted by indents 25. In alternate embodiments, land area 28 may be composed of multiple unconnected areas.

For orientation understanding, as viewed in FIG. 5, each row R1, R2, R3, R4 extends in a longitudinal direction (top to bottom of the figure). The lateral or radial direction extends across rows R1, R2, R3, R4 (left to right of the figure).

In some embodiments, rows R1, R2, R3 and R4 are concentric circles of indents 25 around a center point of the circular lapping plate and thus land areas 28 are also concentric circles around the center point. In other embodiments, rows R1, R2, R3 and R4 are one continuous row of indents 25 spiraling out from or into the center point of the circular lapping plate, and thus land areas 28 are also spiraling out from or into the center point. In some embodiments, indents 25 may be shaped and/or oriented so that the leading edge of indent 25 is not radially aligned.

Figure 6A:
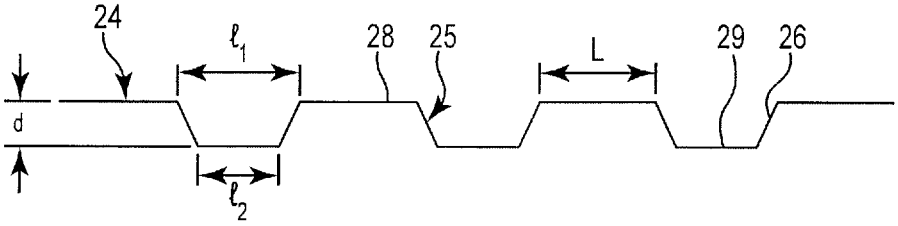
FIG. 6A is a cross-sectional view of an embodiment of a lapping plate in accordance with embodiments of the present disclosure.
Figure 6B:
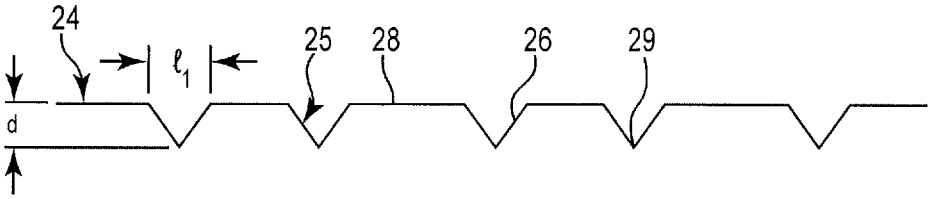
FIG. 6B is a cross-sectional view of another embodiment of a lapping plate in accordance with embodiments of the present disclosure.

FIGS. 6A and 6B illustrate two embodiments of indents 25. In each figure, indents 25 in working surface 24 are separated by land area 28 having a length L. Indent 25 has a side wall 26 extending from working surface 24 to a bottom surface 29. Indent 25 has a maximum width or length dimension $l_1$, measured at working surface 24, and a lesser width of length dimension $l_2$, measured at bottom surface 29. Thus, sidewall 26 is a sloped, angle or slanted sidewall. In FIG. 6B, indent 25 terminates at a point, thus bottom surface 29 has a length dimension $l_2$ of zero (0). Indent 25 has a depth d, measured from working surface 24 to bottom surface 29.

The shape of indent 25 may be any suitable shape, but generally has a sloped sidewall 26 (i.e., the dimension $l_1$, measured at working surface 24 is greater than the dimension $l_2$ at bottom surface 29). When viewed from the top, as in FIG. 5, indents 25 may be circular, oval or elliptical, rectangular (including square), triangular, diamond, or any other polygonal shape. When viewed from the side, as in FIGS. 6A and 6B, indents may be pyramidal (as in FIG. 6B) or truncated or frusto- (as in FIG. 6A). Particularly suitable shapes for indents 25 include truncated pyramidal (e.g., a truncated three-sided, four-sided pyramid), elongated pyramidal and frusto-conical (i.e., a truncated cone). Truncated or frusto-indents may be formed by a patterning tool having teeth with that truncated or frusto-shape, or the truncated or frusto-indents may be formed by a patterning tool having pointed teeth, the tool not being fully pressed into the lapping plate during the patterning process.

FIGS. 6A and 6B represent the view from either direction of the indent row, either longitudinally with the row or lateral to multiple rows (e.g., taken in a radial direction). If a longitudinal view of the row, that shown in the figures is the cross section of a portion of one row (the patterning tool having been moved across the page to make each of the shown indents sequentially); if a lateral or radial view of multiple rows, that shown is the cross section of adjacent rows (each indent being in a different row). Indents 25 may have the same dimensions $l_1$, $l_2$ in the longitudinal direction and the lateral direction, or may be different. For example, a square indent 25 would have $l_1$ and $l_2$ the same in the longitudinal direction and the lateral direction. A rectangular indent 25 would have $l_1$ and $l_2$ in the longitudinal direction different than $l_1$ and $l_2$ in the lateral direction. Indents 25 may be equally spaced (i.e., having the same length L therebetween) or may have varying length L therebetween, with length L viewed in either the longitudinal direction of the row or lateral or radial direction.

The shape and size of indents 25 will differ depending on the lapping process step for which the patterned lapping plate is used. For most lapping processes, the process includes three sequential steps: a rough lapping step, a fine lapping step, and a kiss lapping step. For a rough lapping step, the abrasive particles (e.g., diamonds) are usually about 1 to about 5 micrometers in size; for a fine lapping step, the abrasive particles are usually about 0.1 to about 1 micrometer in size; for a kiss lapping step, the abrasive particles are usually less than 0.1 micrometer.

In general, for any lapping step, the depth d from working surface 24 to bottom 29 is preferably no more than 1000 micrometers, in some embodiments no more than about 500 micrometers. For a rough lapping step, the depth d from working surface 24 to bottom 29 is preferably no more than 100 micrometers, in some embodiments no more than about 10 micrometers, and in some embodiments about 5 to 10 micrometers (e.g., about 6 micrometers); for a fine lapping step, the depth d from working surface 24 to bottom 29 is preferably no more than 10 micrometers, in some embodiments no more than about 1 micrometer; for a kiss lapping step, the depth d from working surface 24 to bottom 29 is preferably no more than 1 micrometer, in some embodiments about 0.5 micrometer of less. In general, for any lapping step, the largest dimension of indent 25, which for a tapered structure will be length $l_1$, is preferably no more than 100 micrometers, in some embodiments no more than about 500 micrometers. For any of the lapping steps, a dimension $l_1$ within the range of about 100 micrometers to about 200 micrometers is suitable.

As one particular example, for a tool having a pattern such as that of FIG. 6A, indent 25 has a greatest dimension $l_1$ at working surface 24 of about 790 micrometers, a dimension $l_2$ at distal end 29 of about 430 micrometers, and a depth d of about 800 micrometers. As another particular example, for a tool having a pattern such as that of FIG. 6B, indent 25 has a greatest dimension $l_1$ at working surface 24 of about 700 micrometers, a pointed distal end 29, and a depth d of about 800 micrometers.

As discussed above, the lapping plate of the present disclosure is formed by forming a pattern into the lapping plate with a toothed patterning tool. In some embodiments, the patterning process of this disclosure may be referred to as roll knurling or form knurling; such a process is done by pressing a wheel or tool against a workpiece with sufficient force to cold form or plastically deform the outer surface of the workpiece. The patterning tool has the inverse of the pattern that is to be imparted to the workpiece.

Figure 7:
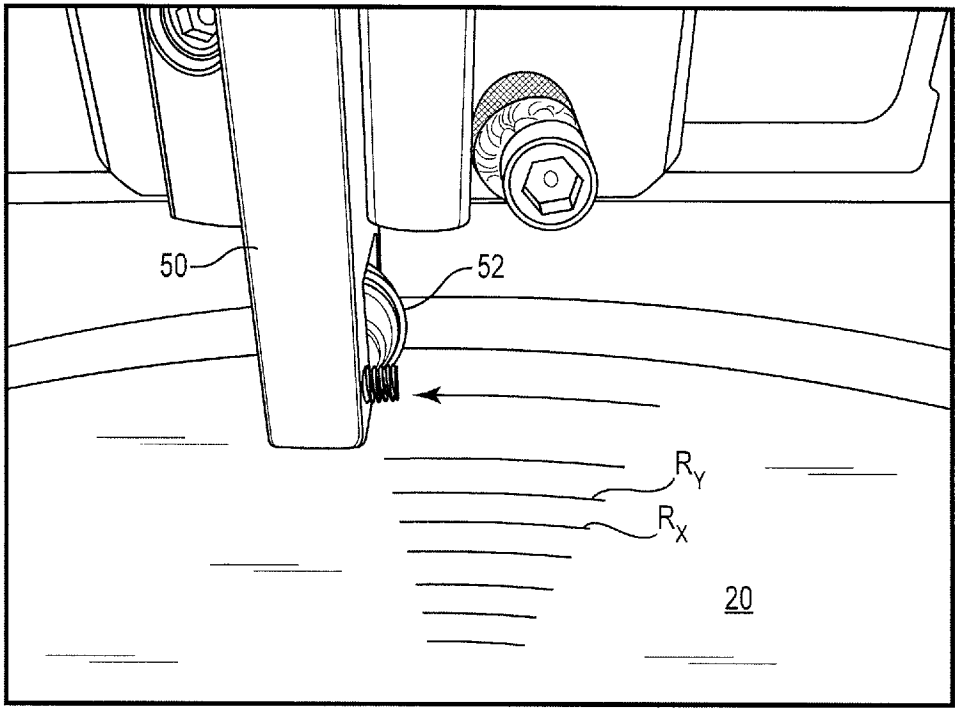
FIG. 7 is a perspective view of a process for forming a lapping plate in accordance with embodiments of the present disclosure.

FIG. 7 illustrates a set-up suitable for providing the patterned lapping plate. A support 50 rotatably retains a toothed patterning tool 52. As support 50 moves radially across rotating lapping plate 20, sufficient pressure is provided by support 50 so that tool 52 contacts plate 20 and imparts the inverse of its pattern in a plurality of rows Rx, Ry, etc. onto plate 20. If support 50 move continuously and uninterrupted radially across rotating lapping plate 20, the result is one continuous spiral of indents in lapping plate 20. Alternately, support 50 may be fixed in position for one rotation of lapping plate 20, after which support 50 is lifted and moved radially (in or out) to another fixed position, and so on; the result is concentric rows of indents in lapping plate 20.

The rows of indents can have equal or unequal spacing (in the radial direction) therebetween. For example, referring to FIG. 5, the radial distance between row R1 and R2 is less than the radial distance between row R2 and R3. Likewise, the radial distance between row R3 and R4 is less than the radial distance between row R2 and R3. FIG. 6B, if showing a lateral view of multiple rows, also shows varying radial distance between rows, whereas FIG. 6A shows an equal distance between rows.

Figure 8:
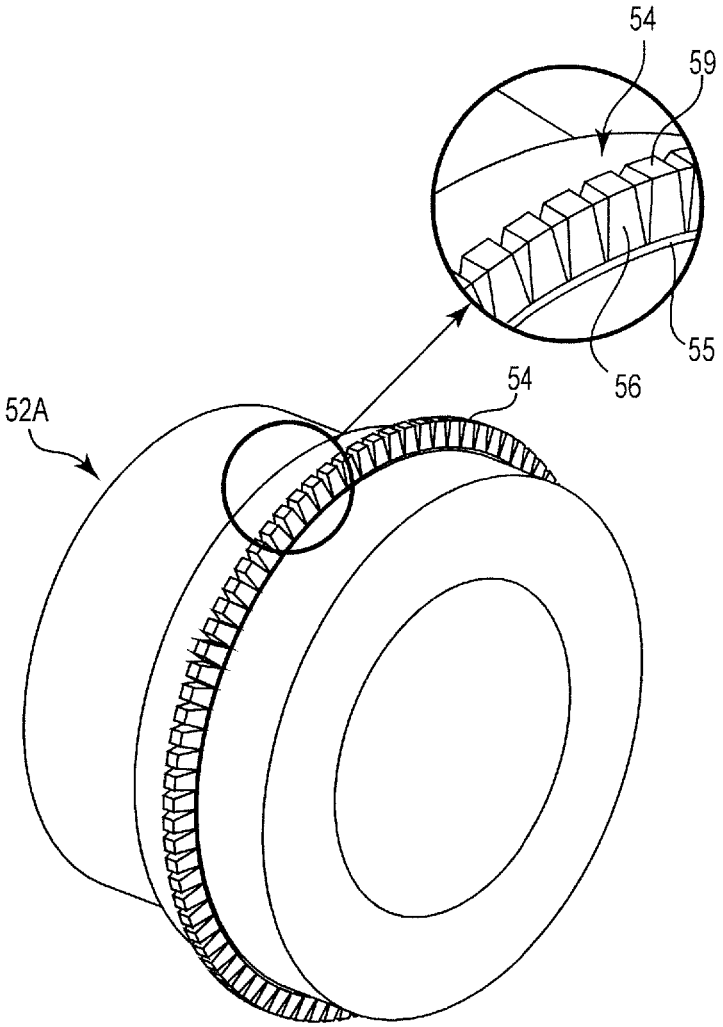
FIG. 8 is a perspective view, with an enlarged inset, of a patterning tool used with embodiments of the present disclosure.
Figure 9:
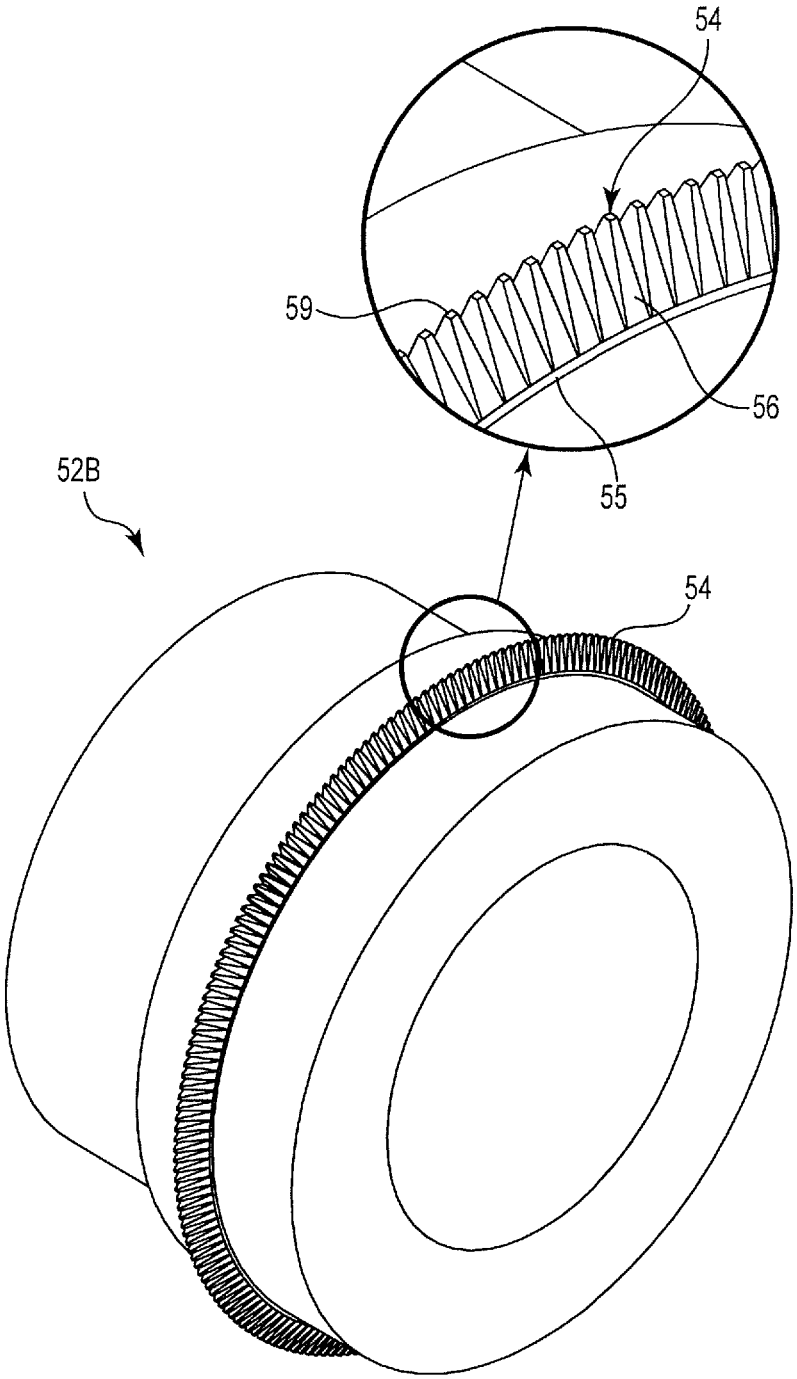
FIG. 9 is a perspective view, with an enlarged inset, of another patterning tool used with embodiments of the present disclosure.

Two examples of suitable patterning tools are illustrated in FIG. 8 and in FIG. 9. FIG. 8 illustrates a first embodiment as patterning tool 52A and FIG. 9 illustrates a second embodiment as patterning tool 52B. Patterning tools 52A, 52B have the same overall general features, and discussion relating to one embodiment also applies to the other embodiment, unless specifically indicated otherwise. Each tool 52A, 52B has a plurality of teeth 54 extending around an outer circumference 55 of the cylindrical tool 52A, 52B. Each tooth 54 has at least one sidewall 56 that extends from outer circumference 55 to a distal end 59. The cross-sectional area (taken essentially parallel to circumference 55) of tooth 54 tapers from outer circumference 55 to distal end 59. For tool 52A of FIG. 8, adjacent sidewalls 56 (i.e., those opposite each other of adjacent teeth 54, in the circumference direction) slant away from each other, whereas the outer sidewalls 56 (i.e., those orthogonal to the sidewalls 56 in the circumferential direction) do not slant but extend orthogonally out from outer circumference 55. Conversely, for tool 52B of FIG. 9, all four sidewalls 56 are angled or slanted in toward distal end 59. All sidewalls 56 may have the same angle from circumference 55 to distal end 59 or may have different angles. In both patterning tool 52A and 52B, distal end 59 is a flat polygon—a rectangle for tool 52A and a square for tool 52B, whereas a tool used to form pointed indents, such as indents 25 of FIG. 6B, would have a point of line defining distal end 59.

To form a patterned lapping plate according to this disclosure, patterning tool 52A, 52B or other is mounted on support 50, as illustrated in FIG. 7. As support 50 moves radially across rotating lapping plate 20, sufficient pressure is provided by support 50 so that the rotating patterning tool deforms the surface of lapping plate 20, imparting the inverse of its pattern in a plurality of rows Rx, Ry, etc. onto plate 20. In some embodiments sufficient pressure may be provided to the patterning tool so that the entire tooth 54 embeds in the plate surface deforming the surface and forming the indent, however, in most embodiments only a portion of tooth 54 will embed in the plate surface.

It is understood that numerous variations of the patterning tools and methods of using the patterning tools could be made to form patterned lapping plates while maintaining the overall inventive design and remaining within the scope of the disclosure. Numerous alternate design or element features have been mentioned above.

Thus, embodiments of the METHOD OF PATTERNING A LAPPING PLATE, AND PATTERNED LAPPING PLATES are disclosed. The implementations described above and other implementations are within the scope of the following claims. One skilled in the art will appreciate that the present invention can be practiced with embodiments other than those disclosed. The disclosed embodiments are presented for purposes of illustration and not limitation, and the present invention is limited only by the claims that follow.

What is claimed is:

1. A metal lapping plate comprising a working surface comprising a plurality of discrete square indents separated by a continuous land area, with an abrasive coating affixed to the lapping plate, the indents comprising:

a depth from the working surface to a terminal end of the indents of no more than 100 micrometers;

all side walls slanting towards each other and extending from the working surface to a terminal end of the indent;

with no side wall of the square indents having a dimension at the working surface greater than 1000 micrometers.

2. The lapping plate of claim 1 wherein the terminal end of the indent is defined by a point.

3. The lapping plate of claim 1 wherein the terminal end of the indent is defined by a flat surface.

4. The lapping plate of claim 1 wherein the depth is no more than about 10 micrometers.

5. The lapping plate of claim 1 wherein the depth is no more than about 1 micrometer.

6. A metal lapping plate comprising a working surface having affixed thereto an abrasive coating, the working surface comprising:

a groove having a length spiraling about a central axis of the lapping plate forming a plurality of turns, the groove having:

slanted side walls tapering from a surface width at the working surface to a terminal width at a terminal end of the groove, the terminal width less than the surface width;

a depth from the working surface to the terminal end of no more than 100 micrometers; and the surface width varying along the length of the groove; and a land area positioned between adjacent turns of the spiraling groove.

7. The lapping plate of claim 6 wherein the terminal end of the groove is defined by a point.

8. The lapping plate of claim 6 wherein the terminal end of the groove is defined by a flat end.

9. The lapping plate of claim 6 wherein the depth of the groove is no more than about 10 micrometers.

10. The lapping plate of claim 6 wherein the surface width of the groove varies along the length of the groove within the range of about 500 to 1000 micrometers.

11. A lapping plate comprising:

a working surface comprising a plurality of elongate grooves concentrically spiraling around a central axis of the working surface, and a land area, the land area having a plurality of abrasive particles secured thereto, the elongate grooves comprising:

a depth from the working surface to a terminal end of the elongate groove of no more than 100 micrometers; and a width at the working surface greater than a width at the terminal end of the elongate groove, with the width at the working surface not constant along a length of the elongate groove.

12. The lapping plate of claim 11, wherein the plurality of elongate grooves comprises a plurality of elongate grooves having no dimension at the working surface greater than 1000 micrometers.

13. The lapping plate of claim 12, wherein the terminal end is defined by a rectangle and the elongate groove comprises four slanted side walls tapering to the terminal end.

14. The lapping plate of claim 11 wherein the terminal end of the elongate groove is defined by a flat surface.

15. The lapping plate of claim 11 wherein the depth is no more than about 10 micrometers.

16. The lapping plate of claim 15 wherein the depth is no more than about 1 micrometer.

* * * * *